US006170917B1

(12) United States Patent
Heinrich et al.

(10) Patent No.: US 6,170,917 B1
(45) **Date of Patent: *Jan. 9, 2001**

(54) PICK-STYLE TOOL WITH A CERMET INSERT HAVING A CO-NI-FE-BINDER

(75) Inventors: Hans-Wilm Heinrich; Manfred Wolf; Dieter Schmidt, all of Bayreuth (DE); Uwe Schleinkofer, Latrobe, PA (US)

(73) Assignee: Kennametal Inc., Latrobe, PA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

This patent is subject to a terminal disclaimer.

(21) Appl. No.: 08/918,990

(22) Filed: Aug. 27, 1997

(51) Int. Cl.[7] ..... E21C 35/183; C22C 29/04

(52) U.S. Cl. ..... 299/105; 299/108; 299/110; 75/240; 51/309; 428/698

(58) Field of Search ..... 51/307, 309; 75/240; 428/469, 698; 299/110, 108, 105

(56) References Cited

U.S. PATENT DOCUMENTS

| | | | | |
|---|---|---|---|---|
| Re. 30,807 | * | 12/1981 | Elders | 299/110 |
| Re. 34,180 | | 2/1993 | Nemeth et al. | 428/547 |

(List continued on next page.)

FOREIGN PATENT DOCUMENTS

| | | |
|---|---|---|
| 29617040 | 3/1997 | (DE) . |
| 1543214 | 10/1968 | (FR) . |
| 2273301 | 6/1994 | (GB) . |
| 46-15204 | 4/1971 | (JP) . |
| 50-110909 | 9/1975 | (JP) . |
| 53-21016 | 2/1978 | (JP) . |
| 54-29900 | 3/1979 | (JP) . |
| 61-194147 | 8/1986 | (JP) . |
| WO9621052 | 7/1996 | (WO) . |
| 9721844 | 6/1997 | (WO) . |

OTHER PUBLICATIONS

U.S. application No. 08/918993, Heinrich et al., filed Aug. 27, 1997.

U.S. application No. 08/918982, Heinrich et al., filed Aug. 27, 1997.

U.S. application No. 08/921996, Heinrich et al., filed Aug. 27, 1997.

Grewe et al.: "Substitution of cobalt in Cemented Carbides," Metall (Berlin (1986) 40(2), 133–140, XP002086162 [Translation].

L. J. Prakash et al.: "The influence of the Binder Composition on the Properties of WC—Fe/Co/Ni Cemented Carbides," Mod. Dev. Powder Metal, vol. 14, 1981, XP002085832.

(List continued on next page.)

*Primary Examiner*—Eileen D. Lillis
*Assistant Examiner*—John Kreck
(74) *Attorney, Agent, or Firm*—John J. Prizzi

(57) ABSTRACT

A pick-style tool that includes an elongate tool body with an axially forward end and an axially rearward end, and a hard insert affixed to the tool body at the axially forward end is disclosed. The hard insert comprises a WC-cermet comprising tungsten carbide and about 5 wt. % to 27 wt. % Co—Ni—Fe-binder. The Co—Ni—Fe-binder is unique in that even when subjected to plastic deformation, the binder substantially maintains its face centered cubic (fcc) crystal structure and avoids stress and/or strain induced transformations.

50 Claims, 1 Drawing Sheet

U.S. PATENT DOCUMENTS

| | | | | |
|---|---|---|---|---|
| 2,162,574 | | 6/1939 | Dawihl et al. | 75/136 |
| 2,202,821 | | 6/1940 | Balke | 75/136 |
| 3,514,271 | | 5/1970 | Yates | 75/233 |
| 3,816,081 | | 6/1974 | Hale | 75/237 |
| 4,049,380 | | 9/1977 | Yih et al. | 428/539.5 |
| 4,083,605 | * | 4/1978 | College et al. | 299/105 |
| 4,556,424 | | 12/1985 | Viswanadham | 75/240 |
| 4,593,776 | | 6/1986 | Salesky et al. | 175/375 |
| 4,642,003 | | 2/1987 | Yoshimura | 408/144 |
| 4,743,515 | | 5/1988 | Fisher et al. | 428/698 |
| 4,869,329 | | 9/1989 | Kar et al. | 175/57 |
| 4,907,665 | | 3/1990 | Kar et al. . | |
| 4,971,485 | | 11/1990 | Nomura et al. | 408/144 |
| 5,066,553 | | 11/1991 | Yoshimura et al. | 428/698 |
| 5,186,739 | | 2/1993 | Isobe et al. | 75/238 |
| 5,219,209 | | 6/1993 | Prizzi et al. . | |
| 5,541,006 | | 7/1996 | Conley | 428/552 |
| 5,658,395 | | 8/1997 | Wahlberg et al. | 148/237 |
| 5,697,042 | | 12/1997 | Massa et al. | 419/10 |
| 5,716,170 | | 2/1998 | Kammermeier et al. | 408/145 |
| 5,766,742 | | 6/1998 | Nakamura et al. | 428/210 |
| 5,776,588 | | 7/1998 | Moriguchi et al. | 428/210 |
| 5,776,593 | | 7/1998 | Massa et al. | 428/212 |
| 5,806,934 | * | 9/1998 | Massa et al. | 299/111 |
| 5,821,441 | | 10/1998 | Kawamura | 75/248 |
| 6,024,776 | * | 2/2000 | Heinrich et al. | 75/238 |

OTHER PUBLICATIONS

Chemical Abstracts, vol. 121, No. 22, Nov. 1994, Abstract No. 261210. (J. M. Guilemany et al.: "Mechanical–Property Relationships of Co/WC and Co—Ni—Fe/WC Hard Metal Alloys," Int. J. Refractory Metals & Hard Materials, (1994), 12(4), 199–206).

B. Uhrenius et al.: "On the Composition of Fe—Ni—Co—WC–based Cemented Carbides," vol. 15, 1997, pp. 139–149, XP002085833.

H. Grewe et al.: "Substitution of Cobalt in Cemented Carbides," Metall (Berlin) (1986), 40)2), 133–40, XP002086162.

Chemical Abstracts, vol. 126, No. 9, Mar. 1997, Abstract No. 121055. (Yoshihiro Minato et al.: "Tungsten Carbide–Based Hard Alloys Having High Impact Resistance for Tools," JP 08 302441 A (Sumitomo Electric Industries, Japan)).

Chemical Abstracts, vol. 114, No. 6, Feb. 1991, Abstract No. 47911. (Noribumi Kikichi et al.: "Manufacture of Surface–Coated Tungsten Carbide–Based Cermets for Cutting Tools," JP02 022454 (Mitsubishi Metal Corp., Japan)).

Chemical Abstracts, vol. 108, No. 12, Mar. 1988, Abstract No. 99568. (Sokichi Taktau et al.: "Alumina–Coated (Mitsubishi Metal Corp., Japan) Sintered Alloys for Cutting Tools," JP 62 047123 (Toshiba Tungaloy Co., Ltd, Japan)).

Copies of International Search Reports mailed Dec. 14, 1998, in Application Nos. PCT/IB98/01297, PCT/IB98/01298, PCT/IB98/01299, PCT/IB98/01300, and PCT/IB98/01301, all Filed Aug. 20, 1998.

Thakur, Dr. Babu N., "The Role of Metal Powders in Manufacturing Diamond Tools," SME Technical Paper, MR85–307, Superabrasives '85 Conference, Apr. 22–25, 1985, Chicago, pp. Title P.–17.

Kennametal Inc., Latrobe, PA, "Hot–Press Diamond Matrix Powders," Publication No. ML86–1(2.5)C6, 1986, pp. Title P.–31.

Kennametal Inc., Latrobe, PA, "Infiltration Diamond Matrix Powders," Publication No. ML86–4(3)G6, 1986, Title P.–27.

Macro Division of Kennametal Inc., Port Coquitlam, B.C., Canada, "Cobamet Alloy Powders," Publication No. CT6086–2, 1986, one page.

Macro Division of Kennametal Inc., Port Coquitlam, B.C., Canada, "Cobamet Alloys," Publication No. AM89–10, 1989, one page.

Table I, entitled "Cobamet Alloy Powder," one page. (No date).

Thümmler, F., et al, "Ergebnisse Zur Weiterentwicklung Von Hartstoffen Und Hartmetallen," (German Language), Proc. Plansee–Semin., 10th (1981), vol. 1, pp. 459–476, Metallwork Plansee GmbH, Reutte, Austria. (English Translation).

Holleck, H., et al., 1977 Annual Report, Aufbau, Herstellung, und Eigenschaften hochschmelzender Verbindungen and Systeme (Harstoffe und Hartmetalle), KfK–Ext. 6/78–1, Institute for Materials and Solid State Research, Kernforschungszentrum in Karlsruhe, Germany, pp. 57–65 including English translation of Oberacker, R., et al., "Properties of Tungsten Carbide Hard Metals with Fe–Co–Ni Binder Alloys, Part I: Effect of Composition, Including Carbon Content," pp. 57–65.

Holleck, H., et al., 1977 Annual Report, Aufbau, Herstellung, und Eigenschaften hochschmelzender Verbindungen and Systeme (Harstoff und Hartmetalle), KfK–Ext. 6/78–1, Institute for Materials and Solid State Research, Kernforschungszentrum in Karlsruhe, Germany, pp. 66–77 including English translation of Prakash, L., "Properties of Tungsten Carbide Hard Metals with Fe—Co—Ni Binder Alloys, Part II: Effect of Heat Treatment," pp. 66–77.

Holleck, H., et al., 1977 Annual Report, Aufbau, Herstellung, und Eigenschaften hochschmelzender Verbindungen and Systeme (Harstoffe und Hartmetalle), KfK–Ext. 6/78–1, Institute for Materials and Solid State Research, Kernsforschungszentrum in Karlsruhe, Germany, pp. 78–86 including English translation of Oberacker, R., et al., "Wettability of Tungsten Carbide By Fe–Co–Ni Binder Alloys," pp. 78–86.

Yin Zhimin et al., "Microstructure and Properties of WC–10 (Fe,Co,Ni) Cemented Carbides," J. Cent.–South Inst. Min. Metall., vol. 25, No. 6, Dec. 1994, pp. 719–722. (English Translation).

"Binary Alloy Phase Diagrams," Second Edition, vol. 1.0 ed., Ed. Massalski, T. B. et al, pp. 136–138, 269–270, 355–356, 471–472, 571, 725–727, 835–836, 902–905. 1990.

Roebuck, B., et al., "Miniaturised thermomechanical tests on hardmetals and cermets" in ed., Sarin, V., "Science of Hard Materials—5," Proceedings of the 5$^{th}$ International Conference on the Science of Hard Materials, Maui, Hawaii, Feb. 20–24, 1995, Materials Science and Engineering, Elsevier Publishing Company, vol. A209, Nos. 1–2, pp. 358–365.

Suzuki, H., et al, "Effects of Surface–Grinding on Mechanical Properties of WC–Co Alloy", Journal of the Japan Institute of Metals (1974), vol. 38, No. 7, pp. 604–608 (Japanese Language with some English Translation).

Suzuki, H., et al, "Room Temperature Transverse–Rupture Strength of WC–10% Ni Cemented Carbide", J. Japan Inst. Met. 41(6), Jun. 1977, pp. 559–563(Japanese Language with some English Translation).

Suzuki, H., et al., Properties of WC–10% (Ni–Fe) Alloys, Department of Metallurgy, Faculty of Engineering, University of Tokyo, Tokyo, pp. 26–31 (Japanese Language with some English Translation).

"Standard Test Method for Flexural Strength of Advanced Ceramics at Ambient Temperature," (Designation: C 1161–90) reprinted from Annual Book of ASTM Standards, American Society for Testing and Materials, Philadelphia, PA.

Prakash, L., et al, "Properties of Tungsten Carbides with Iron–Cobalt–Nickel Alloys as Binders," Sixth International Powder Metallurgy Conference, Dresden, German Democratic Republic, 1977, pp. 39–1–39–16, preprint (German and English Translation).

Penrice, T., "Alternative Binders for Hard Metals," J. Materials Shaping Technology, vol. 5, No. 1, 1987, pp. 35–39, 1987 Springer–Verlag New York Inc.

Farooq, T. et al., "73 A Study of Alternative Matrices for WC Hardmetals," PM 1990's Int. Conf. Powder Metall. (1990), Issue 2, 388–94, Inst. Met., London, U.K., pp. 388–394.

Holleck, H., et al., 1977 Annual Report, Aufbau, Herstellung, und Eigenschaften hochschmelzender Verbindungen and Systeme (Harstoffe und Hartmetalle), KfK–Ext. 6/78–1, Institute for Materials and Solid State Research, Kernforschungszentrum in Karlsruhe, Germany, pp. 1–140 (pp. 87–94 English).

"Binary Alloy Phase Diagrams," Second Edition, vol. 2.0 ed., Ed. Massalski, T. B. et al, pp. 971, 1047–50 & 1179–1265, ASM International. 1990.

Guillermet, A. F., "The Co–Fe–Ni–W–C Phase Diagram: A Thermodynamic Description and Calculated Sections for (Co–Fe–Ni) Bonded Cemented WC Tools," Z. Metallkd. (1989), 80(2), pp. 83–94.

Crook, P., "Cobalt and Cobalt Alloys," Metals Handbook, Tenth Edition, vol. 2 Properties and Selection: Nonferrous Alloys and Special–Purpose Materials (1990), pp. 446–454, ASM International.

Betteridge, W., "Cobalt and Its Alloys," Ellis Horwood Ltd., Halsted Press: a division of John Wiley & Sons, New York, 1982, pp. 41–59.

"Cobalt Facts," Section 10, Cobalt Supply & Demand 1995, pp. 105–112, The Cobalt Development Institute, Essex, U.K.

"Cobalt Monograph," 1960, pp. 170–240. Ed. Centre D'Information du Cobalt, Brussels, Belgium.

Holleck, H. et al., "Constitution of Cemented Carbide Systems," Int. J. Refract. Hard Met. 1, (3), pp. 112–116 (Sep. 1982).

Brabyn, S. M. et al., "Effects of the Substitution of Nickel for Cobalt in WC Based Hardmetal," Proceedings of the 10$^{th}$ Plansee—Seminar 1981 (Metalwork Plansee, Reutte, Austria, Jun. 1–5, 1981) vol. 2, pp. 675–692, Ed. H. M. Ortner.

Schleinkofer, U., et al., "Fatigue of Cutting Tool Materials," Proceedings of the Sixth International Fatigue Congress, 1996, Berlin, Germany, pp. 1639–1644, "Fatigue '96,'" vol. III, Ed. Lütjering & Nowack.

Schleinkofer, U. et al., "Fatigue of Hard Metals and Cermets," Materials Science and Engineering A209 (1996), pp. 313–317.

Schleinkofer, U. et al., "Microstructural Processes During Subcritical Crack Growth in Hard Metals and Cermets under Cyclic Loads," Materials Science and Engineering A209 (1996), pp. 103–110.

Schleinkofer, U., "Fatigue of Hard Metals and Cermets Under Cyclically Varying Stress," (German Language and English Translation), Thesis submitted to the Technical Faculty of the University of Erlangen–Nürnberg, 1995, pp. 11–12, 96–100, 199–203, & 207.

Schleinkofer, U. et al., "Fatigue of Hard Metals and Cermets–New Results and a Better Understanding," Int'l J. of Refractory Metals & Hard Materials 15 (1997), pp. 103–112.

Schleinkofer, U. et al., "Fatigue of Hard Metals and Cermets—The Present Knowledge and its Technical Importance and Application," Proceedings of the 1996 World Congress on Powder Metallurgy & Particular Materials, pp. 18–85 to 18–96, reprinted from Advances in Powder Metallurgy & Particulate Materials–1996.

Brooks, K. J. A., "World Directory and Handbook of Hardmetals and Hard Materials," Sixth Edition, International Carbide Data, pp. D15, D19, D31, D38, D44, D63, D78, D79, D82, D87, D96, D143, D175, D182, D223, D234, D237A. (No date).

Moskowitz, D. et al., "High–Strength Tungsten Carbides," International Journal of Powder Metallurgy 6(4) 1970, pp. 55–64.

Prakash, L. J., "The Influence of Carbide Grain Size and Binder Composition of the Properties of Cemented Carbides," Horizons in Powder Metallurgy (Proc. Of the 1986 International PM Conf. And Exhibition, Dusseldorf, Jul. 7–11, 1986) Part 1, pp. 261–264 (1986).

Prakash, L. et al., "The influence of the Binder Composition on the Properties of WC—Fe/Co/Ni Cemented Carbides," Mod. Dev. Powder Metall. (1981), 14, pp. 255–268.

Roebuck, B., "Magnetic Moment (Saturation) Measurements on Hardmetals," National Physical Laboratory, Dec. 1994, DMM(A)146, pp. 1–12.

Guilemany, J. M., et al., "Mechanical Property Relationships of Co/WC and Co–Ni–Fe/WC Hard Metal Alloys," International Journal of Refractory Metals and Hard Materials 12 (1993–1994), pp. 199–206.

Gabriel, A., et al., "New Experimental Data in the C–Fe–W,– Co–W, C–Ni–W, C–Fe–Ni–W and C–Co–Ni–W Systems Application to Sintering Conditions of Cemented Carbides Optimization of Steel Binder Composition by Partial Factorial Experiments," Int. Inst. of the Science of Sintering Conf. held at Herceg–Novi, Yugoslavia (Sep. 1985), pp. 379–393, published by Plenum Press.

Gabriel, A. et al., "New Experimental Data in the C–Co–W, C–Fe–W, C–Ni–W C–Fe/Ni—W and C–Co/Ni–W Systems and Their Applications to Sintering Conditions," 11$^{th}$ International Plansee Seminar '85, (May 20–24, 1985, Reutte, Tirol, Austria), vol. 2, pp. 509–525, Ed. H. Bildstein & H. M. Ortner.

Mankins, W. L., et al., "Nickel and Nickel Alloys," Metals Handbook, Tenth Edition, vol. 2, Properties and Selection: Nonferrous Alloys and Special–Purpose Materials (1990), pp. 428–445, ASM International.

Uhrenius, B., et al., "On the Composition of Fe–Ni–Co–Wc– Based Cemented Carbides," International Journal of Refractory Metals And Hard Materials 15 (1997), pp. 139–149.

Schubert, W–D., et al., "Phase Equilibria in the Systems Co–Mo–W—C and Ni–Mo—W–C," Translated from German, High Temperatures–High Pressures, 1982, Vo. 14, pp. 87–100.

Raynor, G. V., et al., "Phase Equilibria in Iron Ternary Alloys, A Critical Assessment of the Experimental Literature," The Institute of Metals, 1988, pp. 7, 15, 16, 27–34, 71–80, 140–142, and 213–288.

Prakash, L., "Properties of Tungsten Carbides with an Iron–Cobalt–Nickel Binder in Sintered and Heat–Treated States" (German Language and English Translation), KFK–Nachr. (1979), 11(2), pp. 35–42, Inst. Mater.–Festkoerperforsch., Karlsruhe, Germany.

Sundman B., et al., "The Thermo–Calc Databank System," Calphad, vol. 9, No. 2, 1985, pp. 153–190.

Doi, A. et al., "Thermodynamic Evaluation of Equilibrium Nitrogen Pressure and WC Separation in Ti–W–C–N System Carbonitride," 11$^{th}$ International Plansee Seminar '85 (May 20–24, 1985, Reutte, Tirol, Austria), vol. 1, pp. 825–843, Ed. H. Bildstein & H. M. Ortner.

Gustafson, P., "Thermodynamic Evaluation of C–W System," Materials Science and Technology, Jul., 1986, vol. 2, pp. 653–658.

Ramqvist, L., "Wetting of Metallic Carbides by Liquid Copper, Nickel, Cobalt and Iron,"0 International Journal of Powder Metallurgy 1(4), 1965, pp. 2–21.

Warren, R., "The Wetting of the Mixed Carbide, 50 w/o WC/50 w/o TiC by Cobalt, Nickel and Iron and Some of Their Alloys," International Journal of Powder Metallurgy 4(1), 1968, pp. 51–60.

Zhang Li, et al, "A New Hardmetal for Mining with Ni–Co Binder," Int. J. of Refractory Metals & Hard Materials 14 (1996), pp. 245–248.

* cited by examiner

PICK-STYLE TOOL WITH A CERMET INSERT HAVING A CO-NI-FE-BINDER

BACKGROUND

The present invention pertains to a pick-style tool such as, for example, a road planing tool or a point attack mine tool or an open-face longwall tool, which has a hard insert at the axially forward end. Such pick-style tools have been typically used to penetrate the earth strata or other substrates (e.g., asphalt roadway surfaces) wherein the pick-style tool is carried, either in a rotatable or a non-rotatable fashion, by a drive member (e.g., drum or chain).

The typical pick-style tool has a hard insert affixed at the axially forward end. The hard insert is the part of the pick-style tool that first impinges upon the earth strata or other substrate. The hard insert is comprised of a tungsten carbide cermet (WC-cermet), also known as cobalt cemented tungsten carbide and WC—Co. Here, a cobalt binder (Co-binder) cements tungsten carbide particles together. Although hard inserts made of a WC-cermet having a Co-binder have achieved successful results, there are some drawbacks.

One drawback is that up to about 45 percent of the world's primary cobalt production is located in politically unstable regions (e.g., political regions that have experienced either armed or peaceful revolutions in the past decade and could still experience additional revolutions). About 15 percent of the world's annual primary cobalt market is used in the manufacture of hard materials including WC-cermets. About 26 percent of the world's annual primary cobalt market is used in the manufacture of superalloys developed for advanced aircraft turbine engines—a factor contributing to cobalt being designated a strategic material. These factors not only contribute to the high cost of cobalt but also explain cobalt's erratic cost fluctuations. Consequently, cobalt has been relatively expensive, which, in turn, has raised the cost of the WC-cermet hard insert, as well as the cost of the overall pick-style tool. Such an increase in the cost of the pick-style tool has been an undesirable consequence of the use of the Co-binder for the hard insert. Therefore, it would be desirable to reduce cobalt from the binder of WC-cermet hard inserts.

Furthermore, because of the principal locations of the largest cobalt reserves, there remains the potential that the supply of cobalt could be interrupted due to any one of a number of causes. The unavailability of cobalt would, of course, be an undesirable occurrence.

Pick-style tools operate in environments that are corrosive. While the WC-cermet hard inserts have been adequate in such environments, there remains the objective to develop a hard insert which has improved corrosion resistance while maintaining essentially the same wear characteristics of WC-cermet hard inserts.

While the use of WC-cermet hard inserts have been successful, there remains a need to provide a hard insert that does not have the drawbacks, i.e., cost and the potential for unavailability, inherent with the use of cobalt set forth above. There also remains a need to develop a hard insert for use in corrosive environments which possess improved corrosion resistance while maintaining essentially the same wear characteristics of WC-cermets having a Co-binder.

SUMMARY

In one embodiment, the invention is a pick-style tool which comprises an elongate tool body that has an axially forward end and an axially rearward end. A hard insert is affixed to the tool body at the axially forward end. The composition of the hard insert comprises about 5 weight percent (wt. %) to about 27 wt. % binder, and about 73 wt. % to about 95 wt. % tungsten carbide (WC). The binder comprises a cobalt-nickel-iron-binder (Co—Ni—Fe-binder).

In another embodiment, the invention is a hard insert for use in a pick-style tool having an elongate tool body with an axially forward end. The hard insert is affixed to the tool body at the axially forward end. The composition of the hard insert comprises about 5 wt. % to about 27 wt. % binder, and about 73 wt. % to about 95 wt. % tungsten carbide (WC). The binder comprises a Co—Ni—Fe-binder.

In still another embodiment, the invention is a rotatable cutting tool comprising an elongate tool body that has an axially forward end with a hard insert affixed to the tool body at the axially forward end. The composition of the hard insert about 5 wt. % to about 27 wt. % binder. The binder comprises at least about 40 wt. % cobalt but not more than about 90 wt. % cobalt, at least about 4 wt. % nickel, and at least about 4 wt. % iron. The tungsten carbide has a grain size of about 1 micrometer ($\mu$m) to about 30 $\mu$m.

The invention illustratively disclosed herein may suitably be practiced in the absence of any element, step, component, or ingredient that is not specifically disclosed herein.

BRIEF DESCRIPTION OF THE DRAWINGS

The following is a brief description of the drawings that form a part of this patent application.

DESCRIPTION

Figure 1:
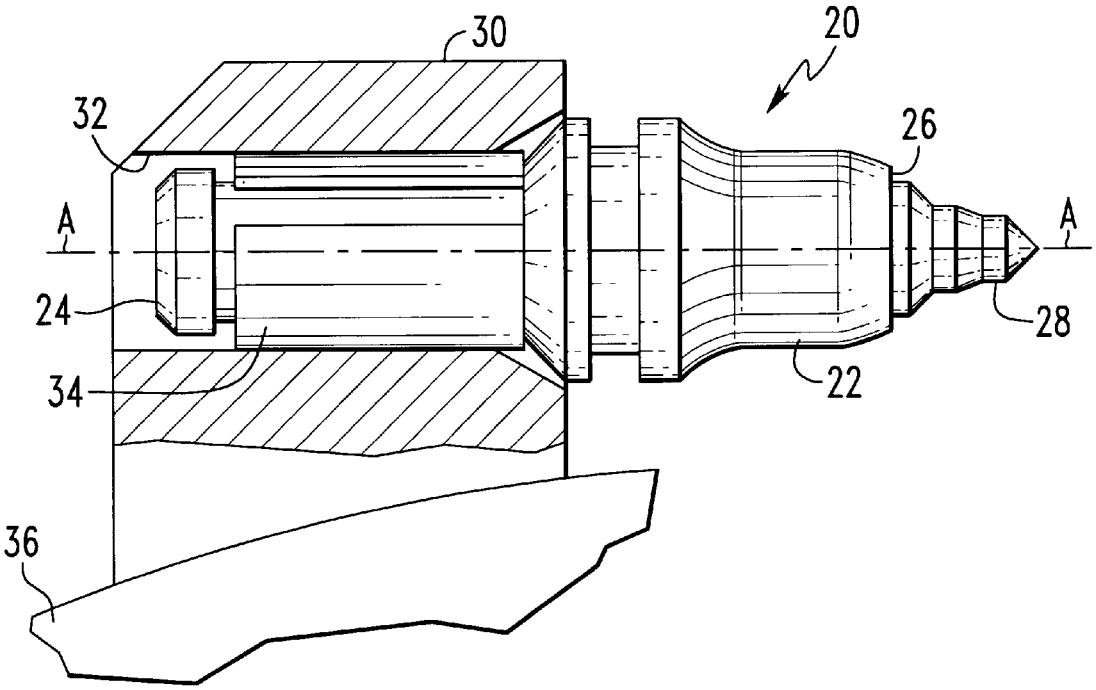
FIG. 1 is a side view of a rotatable pick-style tool rotatably held in a block, wherein a portion of the block has been removed to show the pick-style tool (e.g., a road planing tool mounted to a road planing drum or a mining tool mounted to a mining drum)

Referring to FIG. 1, there is illustrated a rotatable pick-style tool generally designated as 20. A road planing tool as well as a pick-style mine tool are each considered to be a rotatable pick-style tool 20. Pick-style tool 20 has an elongate steel body 22 that has an axially rearward end 24 and an opposite axially forward end 26. A hard insert (or tip) 28 is affixed in a socket in the axially forward end 26 of the tool body 22. The composition of the material from which the hard insert 28 is made will be discussed in detail hereinafter.

The pick-style tool 20 is rotatably carried by a block 30. Block 30 contains a bore 32 in which the rearward portion (or shank) of the tool 20 is retained by the action of a resilient retainer sleeve 34 such as that described in U.S. Pat. No. 4,201,421 to DenBesten et al., which is incorporated by reference herein. The block 30 may be mounted to a drum 36, either road planing or mining, or other drive mechanism known in the art such as for example a chain. During operation, the pick-style tool 20 rotates about its central longitudinal axis A—A. Further description of the road planing tool 20, and especially the geometry of the hard insert 28, is found in U.S. Pat. No. 5,219,209 to Prizzi et al. entitled ROTATABLE CUTTING BIT INSERT assigned to Kennametal Inc. of Latrobe, Pa., the assignee of the present invention. U.S. Pat. No. 5,219,209 is hereby incorporated by reference herein.

Figure 2:
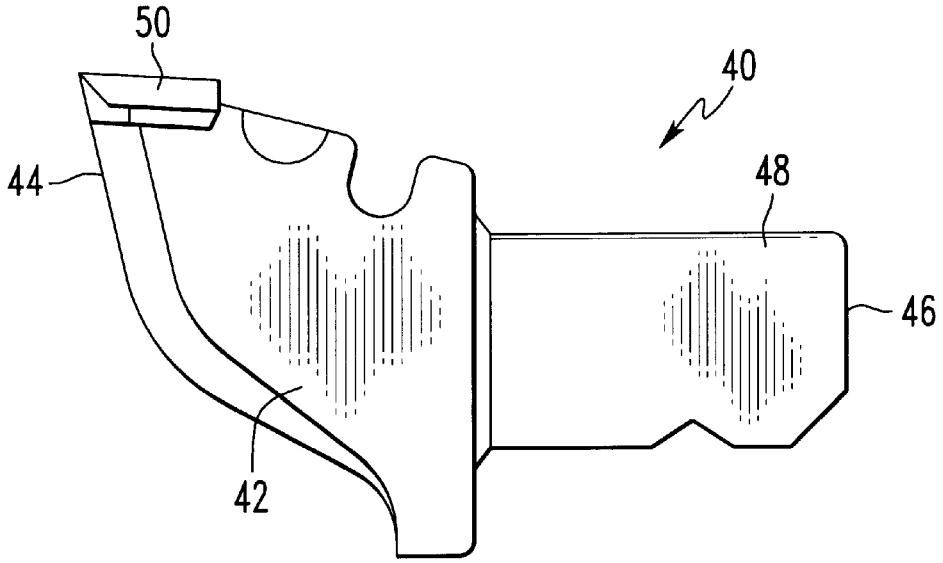
FIG. 2 is a side view of a longwall style mine tool which is held a non-rotatable fashion, i.e., a non-rotatable pick-style mine tool, by a holder mounted to a driven chain or other driven member.

Referring to FIG. 2, there is illustrated a non-rotatable longwall style of mine tool generally designated as 40. The longwall mine tool 40 is considered to be a pick-style mine tool. Longwall tool 40 has an elongate steel body 42 with a forward end 44 and a rearward end 46. The body 42 presents a rearward shank 48 adjacent to the rearward end 46 thereof. The rearward shank 48 is of a generally rectangular cross-section. A hard insert 50 is affixed in a socket at the forward end 44 of the tool body 42. The composition of the material from which the hard insert 50 is made will be discussed in detail hereinafter. During operation, the longwall tool 40 does not rotate about its central longitudinal axis.

In this regard, the composition of WC-cermet having a Co—Ni—Fe-binder from which the hard insert 28 for the pick-style tool 20 (useable for road planing or mining) or the hard insert 50 for the longwall style mine tool 40 comprises a WC-cermet comprising a Co—Ni—Fe-binder and tungsten carbide (WC). The Co—Ni—Fe-binder comprises at least about 40 wt. % cobalt but not more than about 90 wt. % cobalt, at least about 4 wt. % nickel, and at least about 4 wt. % iron. Applicants believe that a Co—Ni—Fe-binder comprising not more than about 36 wt. % Ni and not more than about 36 wt. % Fe is preferred. A preferred composition of the Co—Ni—Fe-binder comprises about 40 wt. % to 90 wt. % Co, about 4 wt. % to 36 wt. % Ni, about 4 wt. % to 36 wt. % Fe, and a Ni:Fe ratio of about 1.5:1 to 1:1.5. A more preferred composition of the Co—Ni—Fe-binder comprises about 40 wt. % to 90 wt. % Co and a Ni:Fe ratio of about 1:1. An even more preferred composition of the Co—Ni—Fe-binder comprises a cobalt:nickel:iron ratio of about 1.8:1:1.

The Co—Ni—Fe-binder of the present invention is unique in that even when subjected to plastic deformation, the binder maintains its face centered cubic (fcc) crystal structure and avoids stress and/or strain induced transformations. Applicants have measured strength and fatigue performance in cermets having Co—Ni—Fe-binders up to as much as about 2400 megapascal (MPa) for bending strength and up to as much as about 1550 MPa for cyclic fatigue (200,000 cycles in bending at about room temperature). Applicants believe that substantially no stress and/or strain induced phase transformations occur in the Co—Ni—Fe-binder up to those stress and/or strain levels that leads to superior performance.

It will be appreciated by those skilled in the art that the Co—Ni—Fe-binder may also comprise at least one secondary alloying element either in place of one or both of nickel and iron and/or in a solid solution with the Co—Ni—Fe-binder and/or as discrete precipitates in the Co—Ni—Fe-binder. Such at least one secondary alloying element may contribute the physical and/or mechanical properties of the WC-cermet. Whether or not the at least one secondary alloying element contributes to the properties of the WC-cermet, the least one secondary alloying element may be included in the Co—Ni—Fe-binder to the extent that the least one secondary alloying element does not detract from the properties and/or performance of the WC-cermet.

The preferred range of the Co—Ni—Fe-binder in the WC-cermet comprises about 5 wt. % to about 27 wt. %. A more preferred range of the Co—Ni—Fe-binder in the WC-cermet comprises about 5 wt. % to about 19 wt. %. An even more preferred range of the Co—Ni—Fe-binder in the WC-cermet comprises about 5 wt. % to about 13 wt. %.

The grain size of the tungsten carbide (WC) of the WC-cermet comprises a broadest range of about 1 micrometers ($\mu$m) and 30 $\mu$m. A mediate range for the grain size of the WC comprises about 1 $\mu$m to 25 $\mu$m.

Applicants contemplate that every increment between the endpoints of ranges disclosed herein, for example, binder content, binder composition, Ni:Fe ratio, hard component grain size, hard component content, . . . etc. is encompassed herein as if it were specifically stated. For example, a binder content range of about 5 wt. % to 27 wt. % encompasses about 1 wt. % increments thereby specifically including about 5 wt. %, 6 wt. %, 7 wt. %, . . . 25 wt. %, 26 wt. % and 27 wt. % binder. While for example, for a binder composition the cobalt content range of about 40 wt. % to 90 wt. % encompasses about 1 wt. % increments thereby specifically including 40 wt. %, 41 wt. %, 42 wt. %, 88 wt. %, 89 wt. %, and 90 wt. % while the nickel and iron content ranges of about 4 wt. % to 36 wt. % each encompass about 1 wt. % increments thereby specifically including 4 wt. %, 5 wt. %, 6 wt. %, . . . 34 wt. %, 35 wt. %, and 36 wt. %. Further for example, a Ni:Fe ratio range of about 1.5:1 to 1:1.5 encompasses about 0.1 increments thereby specifically including 1.5:1, 1.4:1, . . . 1:1, . . . 1:1.4, and 1:1.5). Furthermore for example, a hard component grain size range of about 1 $\mu$m to about 30 $\mu$m encompasses about 1 $\mu$m increments thereby specifically including about 1 $\mu$m, 2 $\mu$m, 3 $\mu$m, . . . 28 $\mu$m, 29 $\mu$m, and 30 $\mu$m.

The present invention is illustrated by the following. It is provided to demonstrate and clarify various aspects of the present invention: however, the following should not be construed as limiting the scope of the claimed invention.

As summarized in Table 1, a WC-cermet having a Co—Ni—Fe-binder of this invention and a comparative conventional WC-cermet having a Co-binder were produced using conventional powder technology as described in, for example, "World Directory and Handbook of HARDMETALS AND HARD MATERIALS" Sixth Edition, by Kenneth J. A. Brookes, International Carbide DATA (1996); "PRINCIPLES OF TUNGSTEN CARBIDE ENGINEERING" Second Edition, by George Schneider, Society of Carbide and Tool Engineers (1989); and "CEMENTED CARBIDES", by P. Schwarzkopf & R. Kieffer, The Macmillan Company (1960). In particular, Table 1 presents a summary of the nominal binder content in weight percent (wt. %), the nominal binder composition, and the hard component composition and amount (wt. %) for a WC-cermet of this invention and a comparative prior art WC-cermet having a Co-binder. That is, commercially available ingredients that had been obtained for each of the inventive and the conventional composition as described in Table 1 were combined in independent attritor mills with hexane for homogeneous blending over a period of about 4.5 hours. After each homogeneously blended mixture of ingredients was appropriately dried, green bodies having the form of plates for properties evaluation were pressed. The green bodies were densified by vacuum sintering at about 1570° C. for about one hour.

TABLE 1

Nominal Composition for Invention and Compactive Conventional WC-Cermet

| Sample | Nominal Binder Content (wt. %) | Nominal Binder Composition (wt. %) Co | Ni | Fe | Hard Component WC* |
|---|---|---|---|---|---|
| Invention | 9.5 | 4.5 | 2.5 | 2.5 | Remainder |
| Conventional | 9.5 | 9.5 | — | — | Remainder |

*starting powder −80 + 400 mesh (particle size between about 38 μm and 180 μm) macrocrystalline tungsten carbide from Kennametal Inc. Fallon, Nevada As summarized in Table 2, the density (g/Cm$^3$), the magnetic saturation (0.1 μTm$^3$/kg), the coercive force (Oe, measured substantially according to International Standard ISO 3326: Hardmetals—Determination of (the magnetization) coercivity), the hardness ($Hv_{30}$, measured substantially according to International Standard ISO 3878: Hardmetals—Vickers hardness test), the transverse rupture strength (MPa, measured substantially according to International Standard ISO 3327/Type B: Hardmetals—Determination of transverse rupture strength) and the porosity (measured substantially according to International Standard ISO 4505: Hardmetals—Metallographic determination of porosity and uncombined carbon) of the inventive and the conventional WC-cermets were determined. The WC-cermet having a Co—Ni—Fe-binder had a comparable hardness but an improved transverse rupture strength compared to the conventional WC-cermet having a Co-binder.

TABLE 2

Mechanical and Physical Properties for Invention and Compactive Conventional WC-Cermet of Table 1

| Sample | Density (g/cm$^3$) | Magnetic Saturation 0.1 μTm$^3$/kg | Hc (Oe) | Hardness (HV30) | TRS (MPa) | Porosity |
|---|---|---|---|---|---|---|
| Invention | 14.35 | 178 | 18 | 970 | 2288 | A04 |
| Conventional | 14.44 | 173 | 54 | 960 | 1899 | A06 |

It can thus been seen that applicants' invention provides for a pick-style tool, as well as the hard insert for the pick-style tool, which overcomes certain drawbacks inherent in the use of cobalt as a binder in the hard insert. More specifically, the use of a Co—Ni—Fe-binder instead of a Co-binder in the hard insert reduces the cost of the hard insert, and hence, the cost of the overall pick-style tool. The use of a Co—Ni—Fe-binder instead of a Co-binder in the hard insert reduces the potential that the principal component, i.e., cobalt, of the binder alloy will be unavailable due to political instability in those countries which possess significant cobalt reserves. It also becomes apparent that applicants' invention provides a pick-style tool, and a hard insert therefor, which possess improved corrosion resistance without sacrificing wear properties equivalent to those of a tungsten carbide-cobalt hard insert.

Other embodiments of the invention will be apparent to those skilled in the art from a consideration of the specification or practice of the invention disclosed herein. It is intended that the specification and examples be considered as illustrative only, with the true scope and spirit of the invention being indicated by the following claims.

What is claimed is:

1. A pick-style tool comprising:

an elongate tool body having an axially forward end and an axially rearward end;

a hard insert affixed to the tool body at the axially forward end thereof; and the hard insert comprising a WC-cermet comprising tungsten carbide and about 5 wt. % to 27 wt. % Co—Ni—Fe-binder comprising about 40 wt. % to 90 wt. % cobalt, about 4 wt. % to 36 wt. % nickel, about 4 wt. % to 36 wt. % iron; a Ni:Fe ratio from about 1.5:1 to 1:1.5; and a face centered cubic (fcc) structure that exhibits substantially no stress and strain induced phase transformations.

2. The pick-style tool of claim 1 wherein the WC-cermet comprises about 5 wt. % to 19 wt. % Co—Ni—Fe-binder.

3. The pick-style tool of claim 2 wherein the WC-cermet comprises about 9.5 wt. % to about 19 wt. % Co—Ni—Fe binder.

4. The pick-style tool of claim 1 wherein claim 1 wherein the WC-cermet comprises about 5 wt. % to 13 wt. % Co—Ni—Fe-binder.

5. The pick-style tool of claim 4 wherein the WC-cermet comprises about 9.5 wt. % to about 13 wt. % Co—Ni—Fe-binder.

6. The pick-style tool of claim 1 wherein the Co—Ni—Fe-binder comprises about 46 wt. % to 57 wt. % cobalt.

7. The pick-style tool of claim 1 wherein the Co—Ni—Fe-binder comprises about 40 wt. % to 90 wt. % cobalt and a Ni:Fe ratio of about 1:1.

8. The pick-style mine tool of claim 1 wherein the Co—Ni—Fe-binder comprises a cobalt:nickel:iron ratio of about 1.8:1:1.

9. The pick-style tool of claim 1 wherein the tungsten carbide has a grain size comprising about 1 μm to about 30 μm.

10. The pick-style tool of claim 1 wherein the tungsten carbide has a grain size comprising about 1 μm to about 25 μm.

11. The pick-style tool of claim 1 wherein the face centered cubic (fcc) structure substantially maintains its fcc structure when subjected to plastic deformation.

12. The pick-style tool of claim 1 wherein Co—Ni—Fe-binder comprises a solid solution face centered cubic alloy.

13. The pick-style tool of claim 1 wherein the tool body has a central longitudinal axis, and the tool is rotatable about its central longitudinal axis during use.

14. The pick-style tool of claim 1 wherein the tool body has a central longitudinal axis, and the tool is non-rotatable about its central longitudinal axis during use.

15. The pick-style tool of claim 1 wherein the fcc structure of the hard insert is substantially maintained when the hard insert is subjected to a bending strength test up to as much as about 2400 megapascal (MPa).

16. The pick-style tool of claim 1 wherein the fcc structure of the hard insert is substantially maintained when the hard insert is subjected to up to about 200,000 cycles at up to about 1550 megapascal (MPa) in a cyclic fatigue test in bending at about room temperature.

17. A hard insert for use in a pick-style tool having an elongate tool body with an axially forward end wherein the hard insert is affixed to the tool body at the axially forward end thereof, the hard insert comprising a WC-cermet comprising tungsten carbide and about 5 wt. % to 27 wt. % of a Co—Ni—Fe-binder comprising about 40 wt. % to 90 wt. % cobalt, about 4 wt. % to 36 wt. % nickel, about 4 wt. % to 36 wt. % iron; a Ni:Fe ratio from about 1.5:1 to 1:1.5; and a face centered cubic structure (fcc) that exhibits substantially no stress and strain induced phase transformations.

18. The hard insert of claim 17 wherein the WC-cermet comprises about 5 wt. % to 19 wt. % Co—Ni—Fe-binder.

19. The hard insert of claim 18 wherein the WC-cermet comprises about 9.5 wt. % to about 19 wt. % Co—Ni—Fe binder comprises about 40 wt. % to 49 wt. % cobalt.

20. The hard insert of claim 17 wherein the WC-cermet comprises about 5 wt. % to 13 wt. % Co—Ni—Fe-binder.

21. The hard insert of claim 20 wherein the WC-cermet comprises about 9.5 wt. % to about 13 wt. % Co—Ni—Fe-binder.

22. The hard insert of claim 17 wherein the Co—Ni—Fe-binder comprises a solid solution face centered cubic alloy.

23. The hard insert of claim 17 wherein the Co—Ni—Fe-binder comprises about 46 wt. % to 57 wt. % cobalt.

24. The hard insert of claim 17 wherein the Co—Ni—Fe-binder comprises about 40 wt. % to 90 wt. % cobalt and a Ni:Fe ratio of about 1:1.

25. The hard insert of claim 17 wherein the Co—Ni—Fe-binder comprises a cobalt:nickel:iron ratio of about 1.8:1:1.

26. The hard insert of claim 17 wherein the tungsten carbide has a grain size comprising about 1 $\mu$m to 30 $\mu$m.

27. The hard insert of claim 17 wherein the tungsten carbide has a grain size comprising about 1 $\mu$m to 25 $\mu$m.

28. The hard insert of claim 17 wherein the fcc structure is substantially maintained when the hard insert is subjected to a bending strength test up to as much as about 2400 megapascal (MPa).

29. The hard insert of claim 17 wherein the fcc structure is substantially maintained when the hard insert is subjected to up to about 200,000 cycles at up to about 1550 megapascal (MPa) in a cyclic fatigue test in bending at about room temperature.

30. A rotatable cutting tool comprising:

an elongate tool body having an axially forward end;

a hard insert affixed to the tool body at the axially forward end thereof; and the hard insert comprising a WC-cermet consisting essentially of about 1 $\mu$m to 30 $\mu$m tungsten carbide and about 5 wt. % to 27 wt. % solid solution face centered cubic (fcc) Co—Ni—Fe-binder comprising about 40 wt. % to 90 wt. % cobalt, about 4 wt. % to 36 wt. % nickel, about 4 wt. % to 36 wt. % iron; a Ni:Fe ratio from about 1.5:1 to 1:1.5; and the solid solution face centered cubic (fcc) structure exhibits substantially no stress and strain induced phase transformations.

31. A pick-style tool comprising:

an elongate tool body having an axially forward end and an axially rearward end;

a hard insert affixed to the tool body at the axially forward end thereof; and the hard insert comprising a WC-cermet comprising tungsten carbide and about 5 wt. % to 9.5 wt. % Co—Ni—Fe-binder comprising about 40 wt. % to 90 wt. % cobalt, about 4 wt. % to 36 wt. % nickel, about 4 wt. % to 36 wt. % iron; a Ni:Fe ratio from about 1.5:1 to 1:1.5; and a face centered cubic (fcc) structure that exhibits substantially no stress and strain induced phase transformations.

32. The pick-style tool of claim 31 wherein the Co—Ni—Fe-binder comprises about 46 wt. % to 57 wt. % cobalt.

33. The pick-style tool of claim 31 wherein the Co—Ni—Fe-binder comprises about 40 wt. % to 90 wt. % cobalt and a Ni:Fe ratio of about 1:1.

34. The pick-style tool of claim 31 wherein the Co—Ni—Fe-binder comprises a cobalt:nickel:iron ratio of about 1.8:1:1.

35. The pick-style tool of claim 31 wherein the tungsten carbide has a grain size comprising about 1 $\mu$m to about 25 $\mu$m.

36. The pick-style tool of claim 31 wherein the tungsten carbide has a grain size comprising about 1 $\mu$m to about 10 $\mu$m.

37. The pick-style tool of claim 31 wherein the face centered cubic (fcc) structure substantially maintains its fcc structure when subjected to plastic deformation.

38. The pick-style tool of claim 31 wherein Co—Ni—Fe-binder comprises a solid solution face centered cubic alloy.

39. The pick-style tool of claim 31 wherein the tool body has a central longitudinal axis, and the tool is rotatable about its central longitudinal axis during use.

40. The pick-style tool of claim 31 wherein the tool body has a central longitudinal axis, and the tool is non-rotatable about its central longitudinal axis during use.

41. A hard insert for use in a pick-style tool having an elongate tool body with an axially forward end wherein the hard insert is affixed to the tool body at the axially forward end thereof, the hard insert comprising a WC-cermet comprising tungsten carbide and about 5 wt. % to 9.5 wt. % of a Co—Ni—Fe-binder comprising about 40 wt. % to 90 wt. % cobalt, about 4 wt. % to 36 wt. % nickel, about 4 wt. % to 36 wt. % iron; a Ni:Fe ratio from about 1.5:1 to 1:1.5; and a face centered cubic (fcc) structure that exhibits substantially no stress and strain induced phase transformations.

42. The hard insert of claim 41 wherein the Co—Ni—Fe-binder comprises about 46 wt. % to 57 wt. % cobalt.

43. The hard insert of claim 41 wherein the Co—Ni—Fe-binder comprises a solid solution face centered cubic alloy.

44. The hard insert of claim 41 wherein the Co—Ni—Fe-binder comprises about 40 wt. % to 90 wt. % cobalt and a Ni:Fe ratio of about 1:1.

45. The hard insert of claim 41 wherein the Co—Ni—Fe-binder comprises a cobalt:nickel:iron ratio of about 1.8:1:1.

46. The hard insert of claim 41 wherein the tungsten carbide has a grain size comprising about 1 $\mu$m to 25 $\mu$m.

47. The hard insert of claim 41 wherein the tungsten carbide has a grain size comprising about 1 $\mu$m to 10 $\mu$m.

48. The hard insert of claim 41 wherein the fcc structure of is substantially maintained when the hard insert is subjected to a bending strength test up to as much as about 2400 megapascal (MPa).

49. The hard insert of claim 41 wherein the fcc structure of is substantially maintained when the hard insert is subjected to up to about 200,000 cycles at up to about 1550 megapascal (MPa) in a cyclic fatigue test in bending at about room temperature.

50. A rotatable cutting tool comprising:

an elongate tool body having an axially forward end;

a hard insert affixed to the tool body at the axially forward end thereof; and the hard insert comprising a WC-cermet consisting essentially of about 1 $\mu$m to 30 $\mu$m tungsten carbide and about 5 wt. % to 9.5 wt. % solid solution face centered cubic (fcc) Co—Ni—Fe-binder comprising about 40 wt. % to 90 wt. % cobalt, about 4 wt. % to 36 wt. % nickel, about 4 wt. % to 36 wt. % iron; a Ni:Fe ratio from about 1.5:1 to 1:1.5; and the face centered cubic (fcc) structure exhibits substantially no stress and strain induced phase transformations.

* * * * *